US006097409A

United States Patent [19]

Murakami

[11] Patent Number: 6,097,409

[45] Date of Patent: Aug. 1, 2000

[54] IMAGE RECORDING APPARATUS

[75] Inventor: Atsushi Murakami, Nagoya, Japan

[73] Assignee: Brother Kogyo Kabushiki Kaisha, Nagoya, Japan

[21] Appl. No.: 08/819,265

[22] Filed: Mar. 18, 1997

[30] Foreign Application Priority Data

May 20, 1996 [JP] Japan ..... 8-149970

[51] Int. Cl.[7] ..... B41J 2/145; B41J 2/15; B41J 2/21

[52] U.S. Cl. ..... 347/40; 347/43

[58] Field of Search ..... 347/41, 40, 12, 347/43

[56] References Cited

U.S. PATENT DOCUMENTS

| | | | |
|---|---|---|---|
| 4,401,991 | 8/1983 | Martin | 347/41 |
| 5,070,345 | 12/1991 | Lahut et al. | 347/41 |
| 5,075,689 | 12/1991 | Hoisington et al. | 347/41 |
| 5,220,342 | 6/1993 | Moriyama | 347/43 |
| 5,455,610 | 10/1995 | Harrington | 347/43 |
| 5,485,183 | 1/1996 | Zandian et al. | 347/41 |
| 5,541,625 | 7/1996 | Holstun et al. | 347/5 |

FOREIGN PATENT DOCUMENTS

| | | | |
|---|---|---|---|
| 60-154080 | 8/1985 | Japan . | |
| 61-104856 | 5/1986 | Japan | 347/43 |

*Primary Examiner*—N. Le
*Assistant Examiner*—Thinh Nguyen
*Attorney, Agent, or Firm*—Oliff & Berridge, PLC

[57] ABSTRACT

An image recording apparatus includes a recording head having a plurality of element arrays in a scanning direction, a driving device, a transporting mechanism and a selecting device. Each element array includes a plurality of recording elements arranged with a predetermined spacing in a direction approximately perpendicular to the scanning direction. The driving device drives the recording elements of the recording head. The transporting mechanism moves the recording head relative to the recording medium in the direction perpendicular to the scanning direction. The selecting device selects between a first recording mode for performing the recording operation with high resolution and high precision and a second recording mode for performing the recording operation with high speed. When the first mode is selected, the recording head moves to record additional dot lines formed by the recording elements of each element array between initial dot lines formed by the same. When the second recording mode is selected, more element arrays are used than in the first recording mode to perform the high speed recording operation. Further, the first mode reduces effects caused by unevenness of the space between each of the element arrays and fluctuations in scanning speed.

19 Claims, 7 Drawing Sheets

IMAGE RECORDING APPARATUS

BACKGROUND OF THE INVENTION

1. Field of the Invention

This invention relates to an image recording apparatus for recording in a dot-matrix form by scanning, for example, an ink jet head in a scan direction relative to a recording medium. In particular, the invention relates to an image recording apparatus that has a plurality of element arrays provided with a plurality of recording elements arranged with a predetermined spacing in a direction approximately perpendicular to the scanning direction.

2. Description of Related Art

Conventionally, an apparatus for recording an image moves a recording head in a scanning direction relative to a recording medium. In this case, the number of recording elements of the recording head in a direction perpendicular to the scanning direction determines a dot density of the image to be printed in a longitudinal direction. For example, recording elements are arranged with a pitch of 1/360 inch in the longitudinal direction in a recording apparatus with a density of 360 dpi (dot/inch). In addition, the length of the recording element array in the longitudinal direction is generally set to a height of a character line to be recorded. That is, approximately one line of text is recorded with one scan.

In conventional image recording apparatus, arranging recording elements in close proximity to each other is necessary to record with high resolution. However, there is physically a limit when arranging recording elements in close proximity to each other. For example, a large number of recording elements, i.e., ink ejecting nozzles, have to be disposed in the longitudinal direction in an ink jet recording head. However, as space between the nozzles becomes small, the small space requires advanced and complicated manufacturing techniques. Thereby, a limit is reached from the viewpoint of manufacturing technique or cost.

It is possible to perform a recording operation with high resolution to some degree by utilizing a recording head 50 as shown in FIG. 7A. The recording head 50 includes a plurality of element arrays (two arrays $\mathbf{50}_{L1}$ and $\mathbf{50}_{L2}$ are illustrated in FIG. 7A) in a scanning direction X. Each element array $\mathbf{50}_{L1}$ and $\mathbf{50}_{L2}$ has a plurality of recording elements 50s arranged with a predetermined spacing in a longitudinal direction Y approximately perpendicular to the scanning direction X. In addition, the element arrays $\mathbf{50}_{L1}$ and $\mathbf{50}_{L2}$ are combined such that each element 50s of one element array 50 is positioned between the elements 50s of the other element array 50. Considering both element arrays $\mathbf{50}_{L1}$, and $\mathbf{50}_{L2}$ as a unit, it appears that the recording elements 50s are arranged relatively close to each other in the direction of Y with the space between the recording elements 50s kept constant. The recording head 50 is scanned in the scanning direction X while controllably driven to slightly deviate the recording timing of each element array $\mathbf{50}_{L1}$ and $\mathbf{50}_{L2}$. Thereby, recording is performed with each of the recording elements 50s of both element arrays $\mathbf{50}_{L1}$ and $\mathbf{50}_{L2}$. As a result, print dots (shown as black circles) are recorded by the one element array $\mathbf{50}_{L1}$ and print dots (shown as white circles) are recorded by the other element array $\mathbf{50}_{L2}$ as shown in FIG. 7B.

The recording head 50 records by one scanning operation such that the dot lines recorded by the recording elements 50s of the element array $\mathbf{50}_{L2}$ are recorded between the dot lines recorded by the recording elements 50s of the element array $\mathbf{50}_{L1}$. In this manner, the space between dot lines becomes half the space P between the elements 50s of each element array $\mathbf{50}_{L1}$ and $\mathbf{50}_{L2}$. However, the positioning precision of print dots is degraded as shown in FIG. 7B because of the adverse effects caused by unevenness of the space D (shown in FIG. 7A) between the element arrays $\mathbf{50}_{L1}$ and $\mathbf{50}_{L2}$ by the manufacturing error of the recording head 50. Further, the positioning precision of print dots in FIG. 7B is degraded by the repeated fluctuation that microscopically varies the scanning speed of the carriage on which the recording head 50 is mounted. For example, in the case of recording a straight line in the longitudinal direction (i.e., the Y direction), the print dots are recorded in a waveform to form a bold straight line, which degrades recording quality and precision. Therefore, the conventional recording head does not afford enhanced precision, with the result that it is unsuitable for the printing operation that requires high resolution and high precision such as image printing.

SUMMARY OF THE INVENTION

This invention provides an image recording apparatus capable of satisfying the conflicting requirements of recording with high resolution and high precision if the recording speed is low and recording with high speed at the expense of precision.

To solve at least the above-described problems, an image recording apparatus according to this invention includes a recording head, a driving device, a transporting mechanism, and a selecting device. The recording head has a plurality of element arrays in a scanning direction with respect to a recording medium. Each element array includes a plurality of recording elements arranged with a predetermined spacing in a direction approximately perpendicular to the scanning direction. The driving device drives the recording elements of the recording head. The transporting mechanism moves the recording head relative to the recording medium in the direction perpendicular to the scanning direction. The selecting device selects between a first recording mode and a second recording mode that differ in a dot pitch. When the first recording mode is selected by the selecting device, the driving device uses one or more element arrays of which number is smaller than that used in the second recording mode. The transporting mechanism affords the recording head and the recording medium the relative motion to record a dot line with the one or more element arrays of the recording head between the dot lines recorded by the same.

Further, all of the plurality of element arrays of the recording head can be used upon selecting the second recording mode. Thus, the second mode is capable of performing high-speed recording. Further, because the plurality of element arrays in the first mode are decreased in number, the effects caused by the unevenness of the space between the element arrays and the fluctuation in the scanning speed are reduced. Accordingly, the image recording apparatus in the first mode enhances the positioning precision of the dots in the scanning direction to perform high precision printing.

The image recording apparatus arranges the recording elements of one element array between the recording elements of at least one additional element array. In the second recording mode, the driving device drives the recording head to record the dot lines formed by the recording elements of the one element array between the dot lines formed by the recording elements of each additional element array. By this, in the second recording mode, the high resolution and high-speed recording can be performed with the increased dot density only by moving the recording head in the scanning direction while slightly deviating the recording timings of the one element array and the each additional element array.

The image recording apparatus also can move the recording head relative to the recording medium to record later dot lines between earlier dot lines formed by the recording elements of each of the element arrays. Thus, the dot density is increased at least twice or more in the direction perpendicular to the scanning direction by recording additional dot lines between previous dot lines, thereby performing the recording operation with increased dot density.

The image recording apparatus can record additional dot lines between the dot lines recorded by the one or more element arrays of the recording head to make the dot pitch smaller in the first recording mode. In this way, compared to the second recording mode, the first recording mode uses a decreased number of the element arrays to provide high resolution and increased dot-positioning precision.

The first recording mode of the image recording apparatus can further move the recording head relative to the recording medium based upon a pitch smaller than the space between the dot lines recorded with the one or more element arrays of the recording head or a pitch obtained by adding the smaller pitch to a distance that is given by a multiple of the space between the recording elements. Thus, it is possible to perform recording with high resolution and high precision by minimizing the pitch of the relative motion between the recording head and the recording medium. Since a motion distance becomes short by minimizing the pitch of the relative motion, for assuring a motion precision, forward motion and backward motion are repeatedly executed by adding and subtracting the minimized pitch of the relative motion to and from a distance given by multiplying the space between the dot lines by an integral number. Thus, the space between the dot lines becomes small when performing high resolution recording.

The image recording apparatus can use only one element array to print. Using one element array eliminates the unevenness of the space between the element arrays when using any dots obtained by suitably dividing the dot pitch of the one element array for high precision printing.

The image recording apparatus can use the driving device to drive the recording elements to vary the dot pitch in the scanning direction according to each recording mode. This image recording apparatus affords the effect of a desired printing resolution by selecting the dot pitch, not only in the relative motion direction perpendicular to the main-scanning direction, but also in the main-scanning direction.

The image recording apparatus can use an ink jet recording head for ejecting ink droplet toward the recording medium. This operation is realized in the image recording apparatus of the ink jet type.

These and other features and advantages of this invention are described in or are apparent from the following detailed description of the preferred embodiments.

BRIEF DESCRIPTION OF THE DRAWINGS

The preferred embodiments of the invention will be described in detail with reference to the following figures wherein.

DETAILED DESCRIPTION OF PREFERRED EMBODIMENTS

Figure 1:
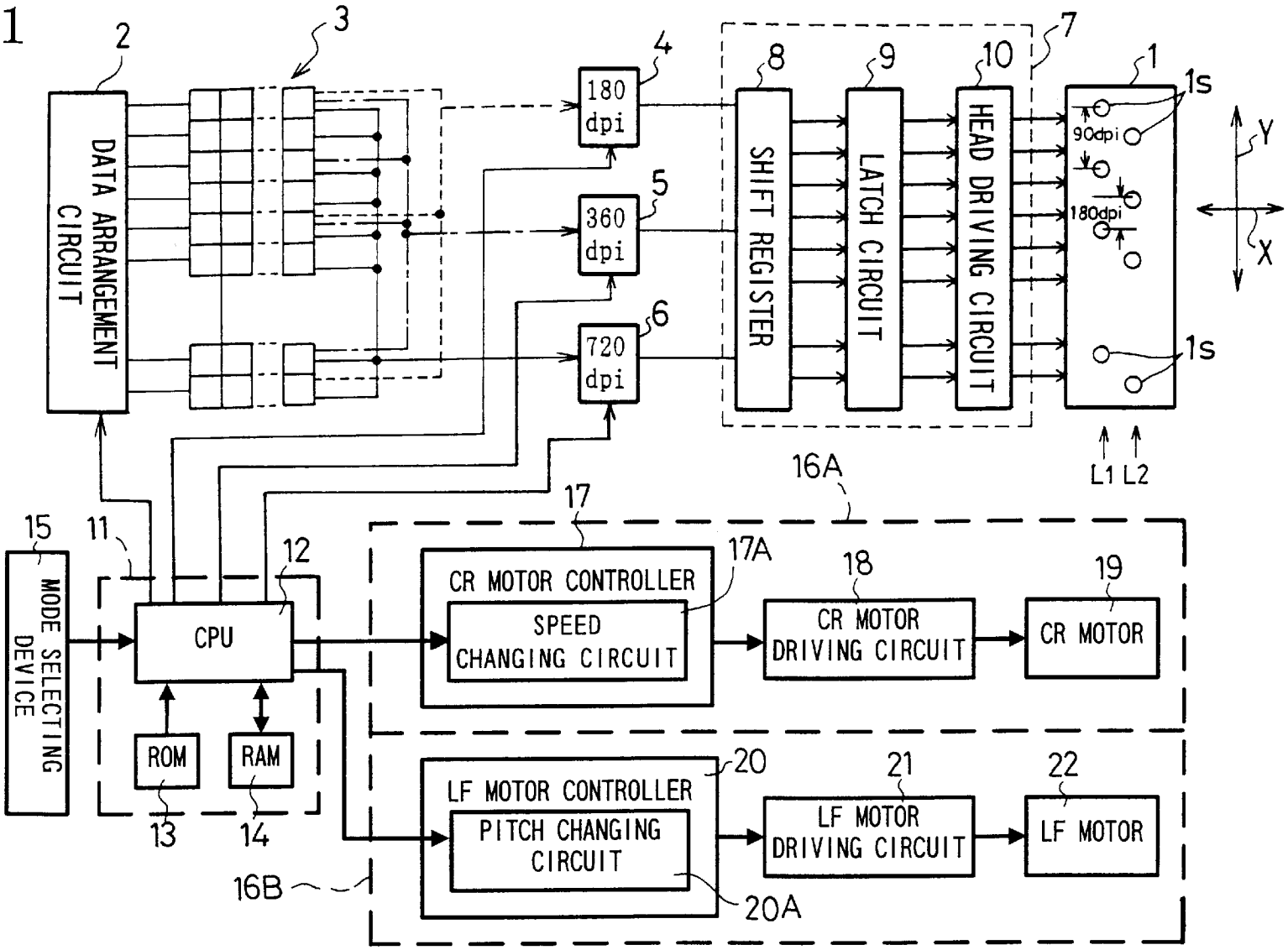
FIG. 1 is a block diagram showing an electrical control system of an image recording apparatus according to one embodiment of the invention.
Figure 2A:
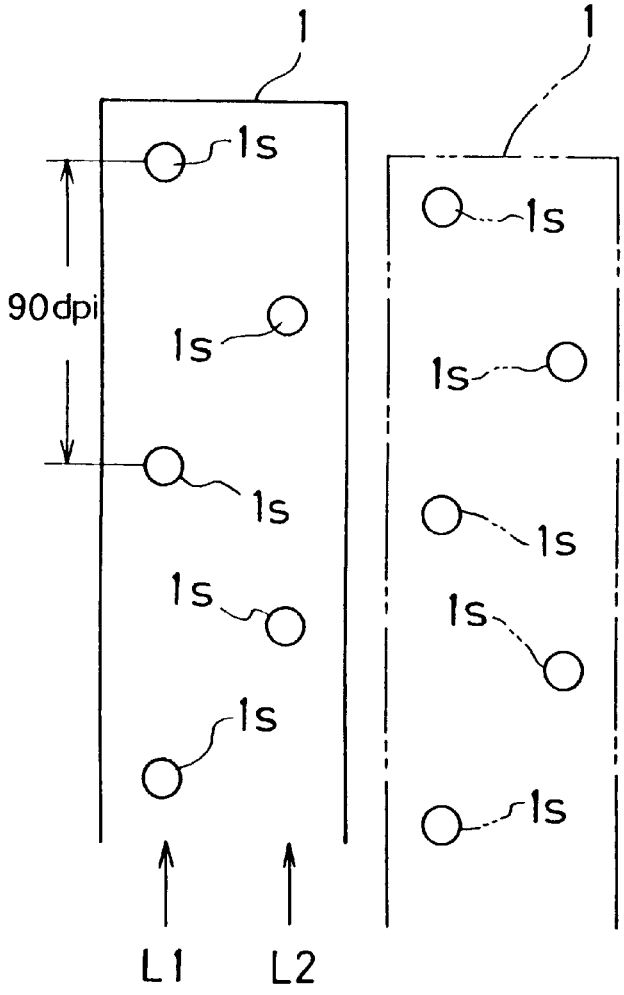
FIGS. 2A and 2B are views showing a recording state of a first recording mode according to one embodiment.
Figure 2B:
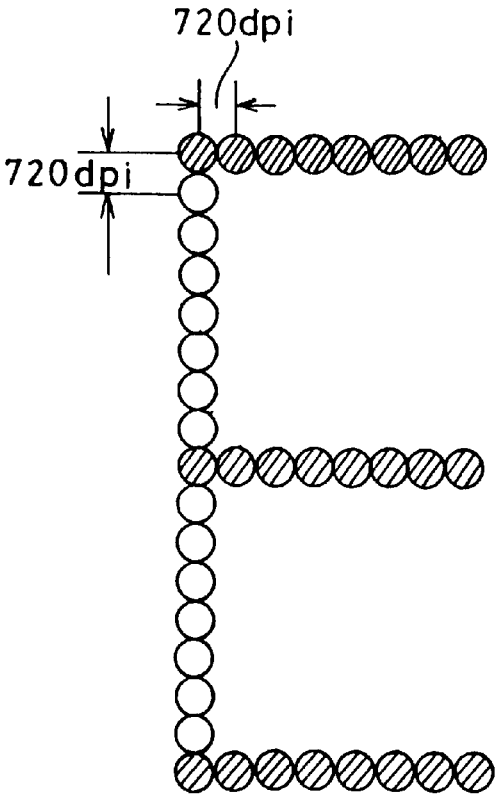

FIG. 1 is a block diagram illustrating an electrical control system of an image recording apparatus according to one embodiment of the invention. In FIG. 1, a recording head 1 is provided with two element arrays L1 and L2 offset in a main-scanning direction X with respect to a recording medium such as a paper (not shown). Each element array L1 and L2 has a plurality of recording elements 1*s* arranged with a spacing (e.g., 1/90 inch) corresponding to, for example, 90 dpi in a sub-scanning direction Y. The sub-scanning direction Y is substantially perpendicular to the main-scanning direction X.

Both the element arrays L1 and L2 are arranged such that the recording element 1*s* of the other element array L2 is positioned in the middle of the space between the recording elements 1*s* of the one element array L1. Accordingly, the adjacent recording elements 1*s* of both element arrays L1 and L2 are arranged with a spacing (e.g., 1/180 inch) corresponding to 180 dpi in the direction of Y. The length of the array of the recording elements 1*s* in both element arrays L1 and L2 is set for one ordinary character line. The recording element 1*s* is an ink ejecting nozzle if the recording head 1 is an ink jet head. The invention applies to other recording heads including the recording head for recording with a dot-matrix form such as a thermal head.

A data arrangement circuit 2 receives an image data formed in, for example, a host computer (not shown) to determine dot data corresponding to a desired resolution. When an instruction of a central processing device 12 of a microcomputer 11 that controls the entire apparatus is received, the data arrangement circuit 2 stores the arranged dot data in a buffer memory 3 having storing areas corresponding to a line number. The buffer memory 3 has storing areas totalling the same as or more than the number of the recording elements 1s in the Y direction.

Reading the dot data out from the buffer memory 3 is selectively performed by any one of first, second and third reading-out circuits 4, 5 and 6. The first reading-out circuit 4 reads out the dot data from the buffer memory 3 for recording with a dot pitch of 180 dpi corresponding to the space between the recording elements 1*s* when both the element arrays L1 and L2 are used in combination. The second reading-out circuit 5 reads out the dot data from the buffer memory 3 for recording two passes with a dot pitch of 360 dpi, which corresponds to a half of the space between the recording elements 1*s* when both element arrays L1 and L2 are arranged in combination. The third reading-out circuit 6 reads out the dot data from the buffer memory 3 for recording with eight passes with a dot pitch of 720 dpi by using either one of the element arrays L1 and L2.

The first-third reading-out circuits 4–6 are selectively driven by the instruction from the central processing device 12 to output the data for one pass by one bit from the buffer memory 3 to a shift register 8.

Driving device 7 drives the recording elements 1s of the recording head 1. The driving device 7 includes the shift register 8, a latch circuit 9 and a head driving circuit 10. The shift register 8 includes a storing area of a plurality of bits in each of the lines that equal the number of the recording elements 1*s*. The latch circuit 9 stores the data received one bit at a time from each line of the shift register 8, which correspond to each recording element 1*s*, and outputs the data to the head driving circuit 10. The latch circuit 9 outputs the data synchronized to a recording timing signal. Each recording element 1*s* operates based upon the data to print on the recording medium.

A mode selecting device 15 selects a recording mode based upon the instruction from the host computer or a manual operation by an operator. A recording dot pitch is different in each recording mode. In this embodiment, it is possible to select either one of a first recording mode or a second recording mode. In the first recording mode, a recording operation with high resolution and high precision is performed using only the element array L1 of the recording head 1 (using the third reading-out circuit 6). In the second recording mode, the recording operation is performed with high speed by using both of the element arrays L1 and L2. Further, in the second recording mode, it is possible to select a high-speed recording mode for recording with high speed and low resolution (using the first reading-out circuit 4) and a high-resolution recording mode for recording with low speed and high resolution (using the second reading-out circuit 5).

In the microcomputer 11, the central processing device 12 reads out a control data previously stored in a RAM 14 based upon the recording mode selected by the mode selecting device 15. The central processing device 12 controls the entire apparatus according to a program in a ROM 13. The central processing device 12 controls the operations of a moving mechanism 16A for moving the recording head 1 in the main-scanning direction X corresponding to the selected recording mode. The central processing device 12 also controls a transporting mechanism (not shown) for relatively transporting the recording medium in the sub-scanning direction Y with respect to the recording head 1. In other words, the central processing device 12 reads out from the RAM 14 the data of the main-scanning speed of the recording head 1 (i.e., of a carriage (not shown)) for the selected recording mode. Based on the data, the central processing device 12 selects and changes a setting speed of a speed changing circuit 17A in a CR motor controller 17.

Normally, the timing for driving the recording elements of the recording head 1 is changed when changing the dot pitch in the main-scanning direction X. Therefore, the main-scanning speed of the recording head 1 is changed to correspond to the timing for driving the recording element. Namely, the CR motor speed changing circuit 17A controls the rotational speed of a CR motor 19 via a CR motor driving circuit 18 based upon the switched setting speed. In this manner, the moving speed of the recording head 1 in the main-scanning direction X is controlled to record with a pitch matching the resolution of the input image data.

The central processing device 12 also reads out from the RAM 14 the data of a motion pitch of the recording medium for the selected recording mode. Based on the data, the central processing device 12 selects and changes the setting pitch of a pitch changing circuit 20A in an LF motor controller 20. The LF motor pitch changing circuit 20A controls the rotation of an LF motor 22 via an LF motor driving circuit 21 based upon the switched setting pitch. In this manner, the moving pitch of the recording medium in the sub-scanning direction Y is controlled to record with a pitch matching the resolution of the input image data.

An operation of the image recording apparatus will be explained with reference to the block diagram of FIG. 1 and FIGS. 2 to 4, which show various recording states. First, the case of operating the first recording mode (the third reading-out circuit 6) selected by the mode selecting device 15 is explained with reference to FIGS. 2A and 2B.

When the first recording mode (the third reading-out circuit 6) is selected, the data arrangement circuit 2 instructed from the central processing device 12 arranges the input image data into dot data with a density of 720×720 dpi. The dot data is stored in the buffer memory 3. Subsequently, the third reading-out circuit 6 reads out from the buffer memory 3 the dot data corresponding to the recording element 1*s* of the element array L1. The third reading-out circuit 6 outputs one byte each for every eighth line from the top to the shift register 8. The data stored in the shift register 8 is sent one bit per line to be stored in the latch circuit 9. Synchronized by the recording timing, the latch circuit 9 outputs to the head driving circuit 10 the dot data corresponding to the recording elements 1*s* of the one element array L1. The recording elements 1*s* of the element array L1 operate based upon the data to perform recording on the recording medium as shown by black circles in FIG. 2B.

Simultaneously, the central processing device 12 outputs the necessary instruction to the driving device 7 for operating the recording elements 1*s* with a timing corresponding to 720 dpi. A speed data of the CR motor 19 corresponding to the timing of the driving device 7 is read out from the RAM 14 to be set in the CR motor speed changing circuit 17A. The CR motor driving circuit 18 controls the rotational speed of the CR motor 19 based upon the speed data. Accordingly, the recording head 1 is moved by the carriage in the main-scanning direction X with a predetermined speed. Further, the print dots are recorded with close pitch corresponding to the high resolution of 720 dpi in the main-scanning direction X, as shown by the black circles in FIG. 2B, by changing the interval of the recording timing signal of the recording element 1*s* using the driving device 7.

Moreover, the central processing device 12 reads out from the RAM 14 the motion pitch of the LF motor 22 corresponding to 720 dpi to set in the LF motor pitch changing circuit 20A. The LF motor driving circuit 21 rotates the LF motor 22 by a predetermined rotational angle based upon the motion pitch every time the scanning operation of the recording head 1 in the main-scanning direction is completed. Thus, the recording medium is transported in the sub-scanning direction Y by the pitch corresponding to the density of 720 dpi. Thereafter, the dot data of the line adjacent to the previous line is read out from the buffer memory 3. Then, the recording head 1 is moved again in the main-scanning direction X, to thereby record the next dot line in the same manner as the above-mentioned procedure. This operation is repeated eight times. Thus, the printing operation is performed with the high resolution of 720×720 dpi when the recording head 1 has completed eight scans in the main-scanning direction X.

Figure 7A:
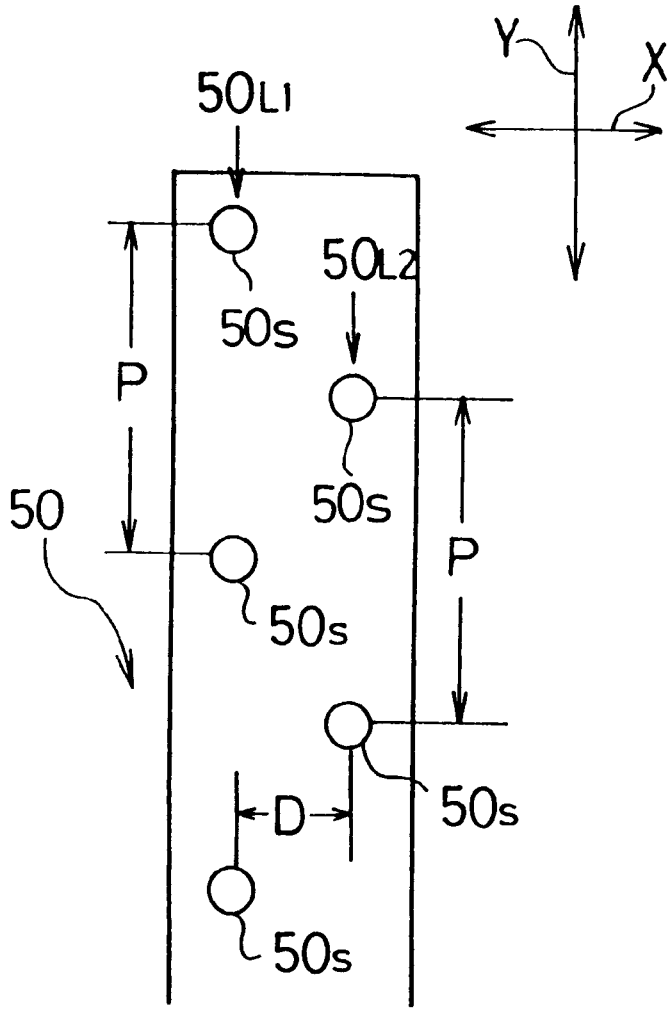
Fig.7A PRIOR ART
FIGS. 7A and 7B are views showing a recording state by an ink jet printer of a conventional image recording apparatus.
Figure 7B:
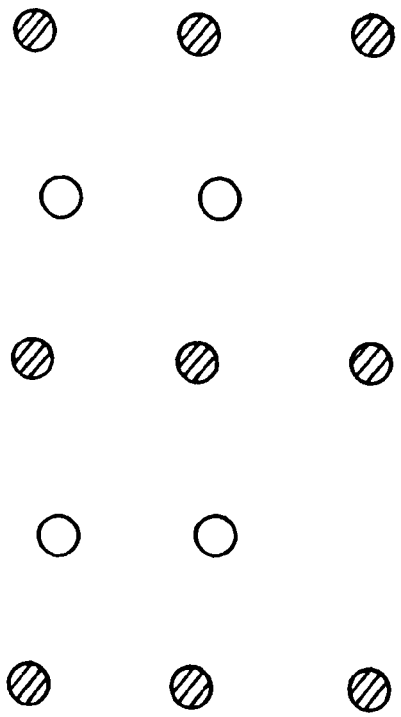
Fig.7B PRIOR ART

In the first recording mode, the recording is executed with the high resolution of 720×720 dpi. Further, only a single vertical element array (L1) is utilized. Accordingly, there is no effect caused by a manufacturing error in the space D (shown in FIG. 7A) between both element arrays (e.g., L1 and L2) of the recording head 1. In addition, there is no effect caused by microscopic fluctuations in the scanning speed of the carriage. In this manner, extremely high positional precision is obtained by the print dots in the longitudinal direction and a high quality image can be obtained with high resolution and high precision. Therefore, the first recording mode is suitable for high quality recording that tolerates relatively slow recording speed, for example, image data recording. Because transporting the recording medium in the subscanning direction Y every pitch corresponding to the density of 720 dpi is too fine, forward motion and backward motion are repeatedly performed at the distance of 720 dpi+90a dpi, where "a" is an integer, to enhance the transportation precision and to obtain higher image quality.

Next, the case in which the second recording mode (the first reading-out circuit 4 or the second reading-out circuit 5) is selected by the mode selecting device 15 is explained. Initially, the case in which the high-speed recording mode (using the first reading-out circuit 4) is selected is explained with reference to FIG. 1 and FIGS. 3A and 3B.

Figure 3A:
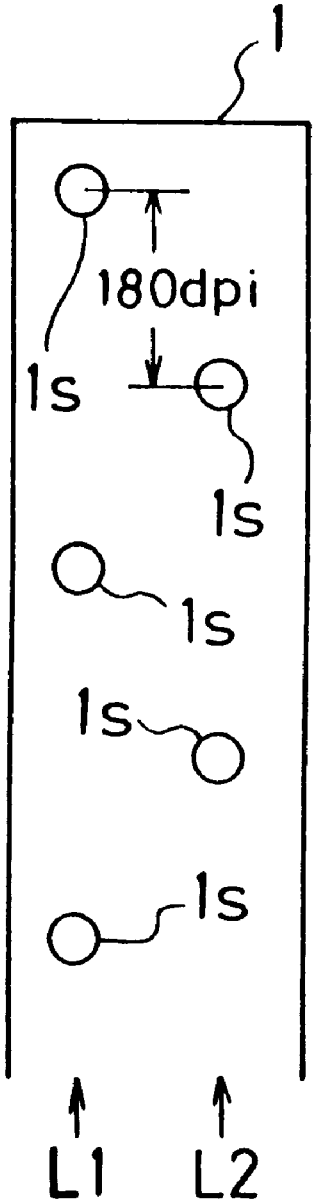
FIGS. 3A and 3B are views showing a recording state for a high-speed printing of a second recording mode according to one embodiment.
Figure 3B:
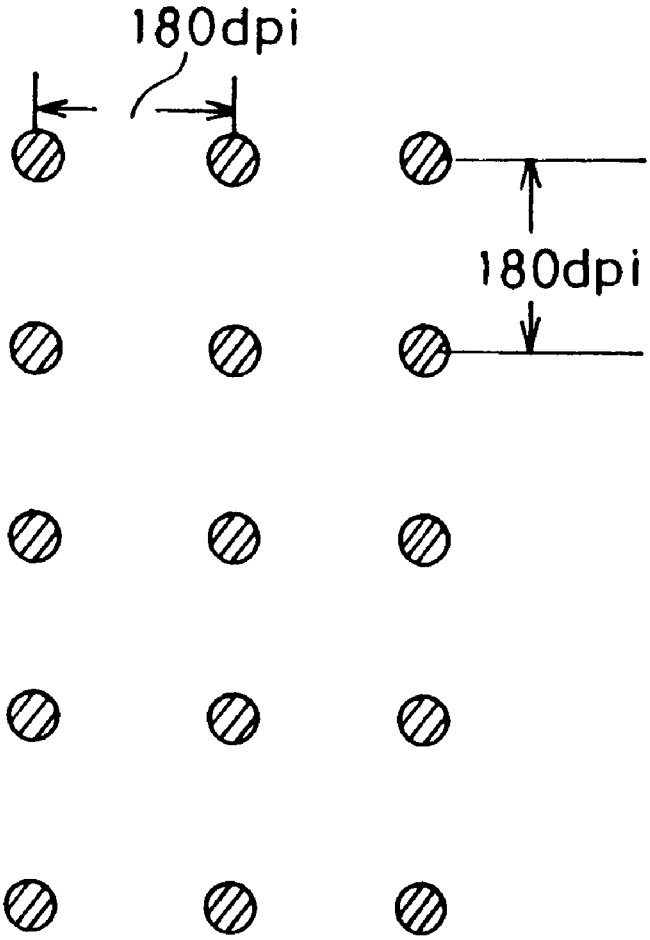

The data arrangement circuit 2 instructed from the central processing device 12 arranges the input image data into the dot data with a density of 180×180 dpi. This dot data is stored in each line of every fourth line in the buffer memory 3. Subsequently, the first reading-out circuit 4 reads out the dot data by one byte each for every fourth line in the buffer memory 3. The first reading-out circuit 4 then outputs the data to the shift register 8. The data stored in the shift register 8 is sent one bit from each line to be stored in the latch circuit 9. The latch circuit 9 outputs to the head driving circuit 10 the dot data corresponding to the recording elements 1*s* of both element arrays of the recording head 1 synchronized by the recording timing. The recording elements 1*s* of both element arrays L1 and L2 operate based upon the data to record on the recording medium as shown in FIG. 3B.

Simultaneously, the central processing device 12 changes the recording timing signal of the driving device 7 to correspond to 180 dpi. The CR motor controller 17 controls the rotational speed of the CR motor 19 to execute high speed printing. Accordingly, the print dots are recorded with the spacing corresponding to the density of 180 dpi with respect to the main-scanning direction X as shown in FIG. 3B. After one scanning operation of the recording head 1 in the main-scanning direction X is completed, the recording operation of one character line in one line is completed. Therefore, the high speed recording of the second mode (using the first reading-out circuit 4) is suitable for recording with high speed even if the image quality is somewhat degraded. The high speed recording of the second mode can be used, for example, when recording a document having only characters.

Figure 4A:
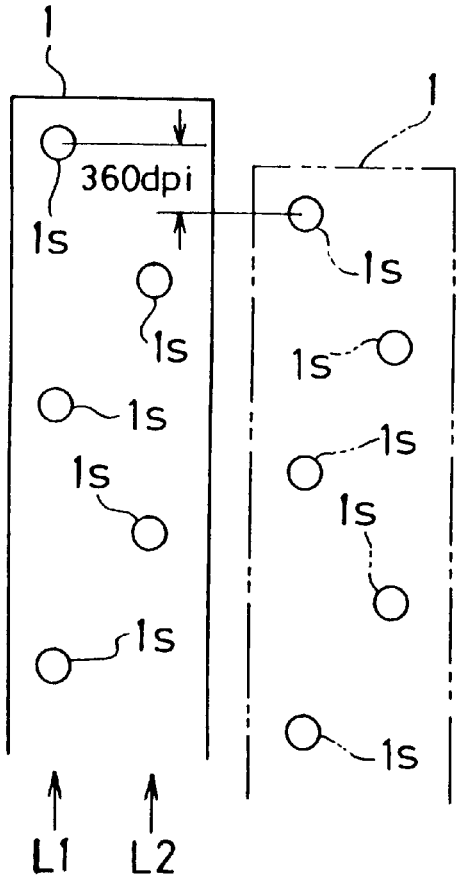
FIGS. 4A and 4B are views showing a recording state for a high-density printing of the second recording mode according to one embodiment.

Next, the case in which the high-resolution recording (using the second reading-out circuit 5) of the second recording mode is selected will be explained with reference to FIG. 1 and FIGS. 4A and 4B. The data arrangement circuit 2 instructed from the central processing device 12 arranges the input image data into the dot data with the density of 360×360 dpi. This dot data is stored in each line of every second line in the buffer memory 3. Subsequently, the second reading-out circuit 5 instructed from the central processing device 12 reads out the dot data by one byte each from an odd-numbered line of every second line in the buffer memory 3 to output to the shift register 8. The data stored in the shift register 8 is sent one bit per line to be stored in the latch circuit 9. Synchronized by the recording timing, the latch circuit 9 outputs to the head driving circuit 10 the dot data corresponding to the recording elements 1*s* of both element arrays of the recording head 1. The recording elements 1*s* of both element arrays L1 and L2 operate based upon the data to record on the recording medium as shown by the black circles in FIG. 4B.

Simultaneously, the central processing device 12 changes the recording timing signal of the driving device 7 to correspond to 360 dpi. The CR motor controller 17 controls the rotational speed of the CR motor 19 to a predetermined amount. Accordingly, the print dots are recorded with the spacing corresponding to the density of 360 dpi with respect to the main-scanning direction X as shown in FIG. 4B.

Moreover, the central processing device 12 reads out from the RAM 14 the motion pitch of the LF motor 22 corresponding to 360 dpi to set in the LF motor pitch changing circuit 20A. The LF motor driving circuit 21 rotates the LF motor 22 by a predetermined rotational angle based upon the motion pitch after one scanning operation by the recording head 1 in the main-scanning direction X is completed. In this manner, the recording medium is transported in the subscanning direction Y by the pitch corresponding to the density of 360 dpi, as shown in FIG. 4A.

Thereafter, the second reading-out circuit 5 instructed from the central processing device 12 reads out the dot data by one byte each from an even-numbered line of every second line in the buffer memory 3 to output to the shift register 8. The data stored in the shift register 8 is sent one bit per line to be stored in the latch circuit 9. The latch circuit 9 outputs to the head driving circuit 10 the dot data corresponding to the recording elements 1*s* of both element arrays of the recording head 1 in synchronism with the recording timing.

Figure 4B:
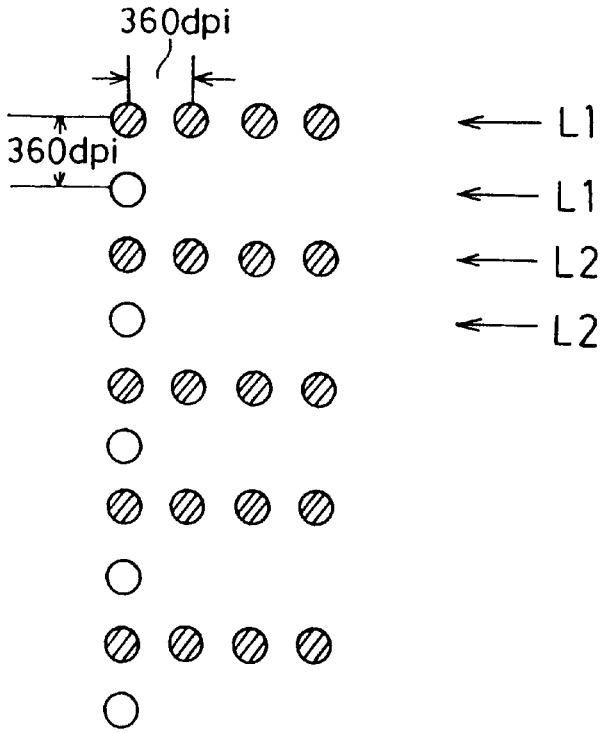

The recording elements 1*s* of both element arrays operate based upon the data to record onto the recording medium as shown by white circles in FIG. 4B. In this way, one character line is recorded with the density of 360×360 dpi when the recording head 1 is scanned twice in the main-scanning direction X.

Normally, as the density in the longitudinal direction doubles, the density in the widthwise direction also doubles. Therefore, performing the recording operation of the second recording mode with high resolution requires a memory capacity four times as large as that of the recording operation of the second mode with high speed. Therefore, the buffer memory can be effectively utilized by closely developing the data in the buffer memory as shown in FIGS. 3 and 4, not skipping lines shown in FIG. 1.

The high-resolution recording can be executed with high density of dots even if the positional precision in the longitudinal direction of the print dots are somewhat degraded in the high-resolution recording mode in the second recording mode. Therefore, the high-resolution recording of the second recording mode is suitable for recording a clear document with high printing density.

The block diagram of FIG. 1 shows a printer adapted to MS-DOS (the trademark of Microsoft Co., Ltd.), for example. More particularly, FIG. 1 shows a printer for transmitting coded character information from a host computer to the printer to cause the buffer memory 3 of the printer to perform data development corresponding to one printing line or two printing lines. In this case, the mode selecting device 15 is automatically transmitted as mode designating information from the host computer to the printer using a control code.

In the case of the printer adapted to WINDOWS (the trademark of Microsoft Co., Ltd.), the data corresponding to the first recording mode or the second recording mode is developed in the buffer memory of the host computer. In this case, the host computer is capable of sending the data of every character line to the printer, which performs the print data development, with the mode designating information. Alternatively, the printer can receive the coded character information for each dot line from the host computer.

Next, an embodiment of a color ink jet printer to which the above-mentioned image recording apparatus is adapted and the ink jet head thereof will be explained with reference to FIG. 5 and FIG. 6.

Figure 5:
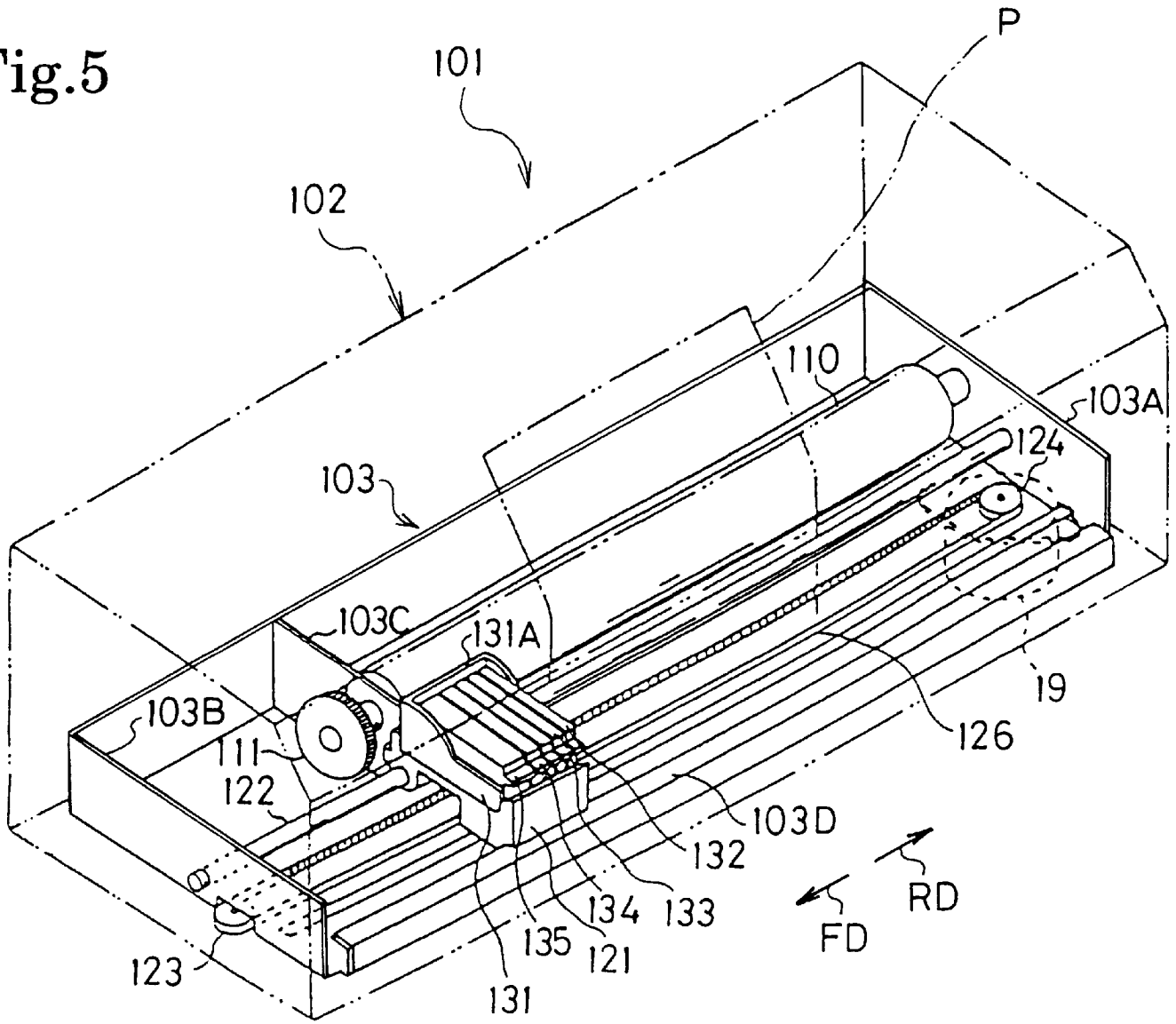
FIG. 5 is a perspective view showing an ink jet printer to which an image recording apparatus of the invention is adapted.

As shown in FIG. 5, a color ink jet printer 101 includes a main body frame 103 mounted in a main body cover 102. The color ink jet printer further includes a rubber platen 110, a carriage driving mechanism, such as the moving mechanism 16A of FIG. 1, for driving a carriage 121 and an ejecting mechanism, such as the driving device 7 of FIG. 1, for ejecting ink to a recording paper P from a plurality of element arrays in ink jet heads 1A–1D, which house corresponding ink cartridges 132–135.

The platen 110 is arranged from left to right as shown in FIG. 5. Each edge portion of the shaft of the platen is rotatably supported to each side wall plate 103A and 103C, respectively, of the main body frame 103. Disposed at the left edge portion of the shaft of the platen is a platen gear 111 that connects to the LF motor 22 (see FIG. 1) via a platen driving mechanism (not shown). The rotation of the LF motor 22 in a predetermined rotating direction is transmitted to the platen gear 111 via the platen driving mechanism to drive the platen 110 in a predetermined paper transporting direction.

Additional details of the carriage driving mechanism will now be explained. The carriage 121 is arranged in the horizontal direction in front of the platen 110. The carriage 121 is arranged parallel to the platen 110 in its rear edge portion to be reciprocally supported (rightward and leftward directions) by a guide rod 122 supported by side wall plates 103A and 103B of the main body frame 103. The carriage 121 is also movably supported at its front edge portion in the rightward and leftward directions by a guide rail 103D disposed at the front edge portion of the main body frame 103.

A follower pulley 123 is rotatably supported to the side wall plate 103B at the left edge portion of the range where the carriage 121 moves, and a driving pulley 124 attached to a driving shaft of the CR motor 19 is provided to the right edge portion of the range where the carriage 121 moves. An endless timing belt 126 is placed around both pulleys 123 and 124 and is connected to the carriage 121 at its lower edge portion. When the CR motor 19 is rotatably driven by a driving pulse, the carriage 121 is supported by the guide rod 122 and the guide rail 103D to be reciprocatingly driven in a direction shown by an arrow FD or a direction shown by an arrow RD via the pulleys 123 and 124 and the timing belt 126.

Additional details of the ink ejecting mechanism will now be explained. A box-type head holder 131 is provided above the carriage 121. The box type head holder 131 is open at the upper side and front side. The head holder 131 is provided with a cyan ink cartridge 132 accommodating cyan ink, a magenta ink cartridge 133 accommodating magenta ink, a yellow ink cartridge 134 accommodating yellow ink and a black ink cartridge 135 accommodating black ink. Each of cartridges 132–135 is removably attached to the head holder 131.

A cyan-ink recording head 1A, a magenta-ink recording head 1B, a yellow-ink recording head 1C and a black-ink recording head 1D are provided at wall portion 131A of the head holder 131. Each recording head has 64 ejecting nozzles (recording elements). The recording heads 1A–1D are provided side by side in the main-scanning direction. An electromechanical transducer for ejecting ink is respectively provided at each of 64 ejecting nozzles of each of the recording heads 1A–1D. Sixty-four electromechanical transducers are driven to record a full-color image onto the recording paper P using the four color inks ejected from the plurality of ejecting nozzles.

Figure 6:
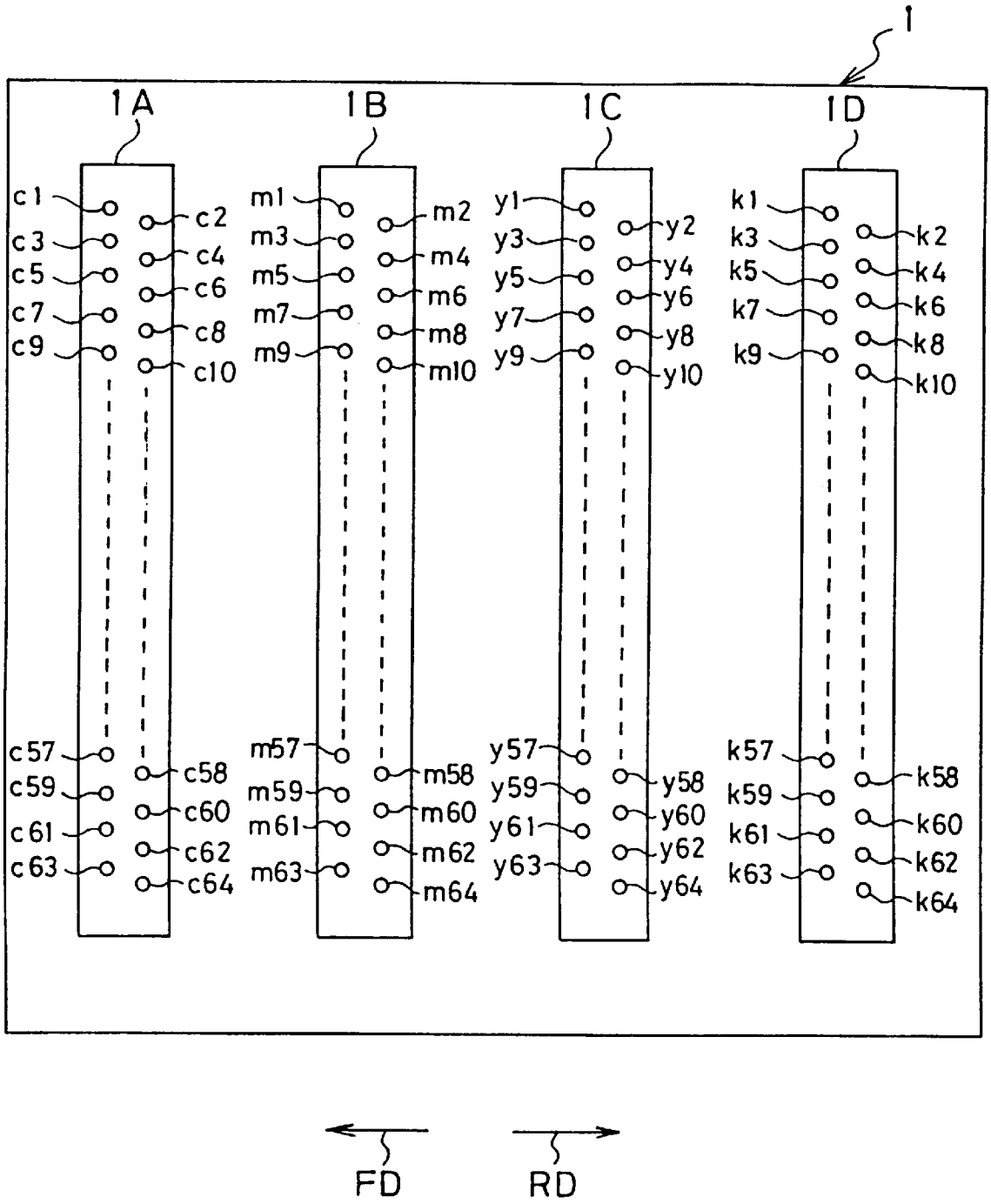
FIG. 6 is a view showing a construction of an ink jet head of the ink jet printer shown in FIG. 5.

The arrangement of the ejecting nozzles for each recording head 1A–1D is shown in FIG. 6. Sixty-four ejecting nozzles that are separated into two element arrays in the longitudinal direction are formed at each recording head 1A–1D. The recording head 1A has 32 odd-numbered ejecting nozzles (c1, c3, c5 . . . c61, c63) arranged in the first line with a predetermined pitch. The recording head 1A also has 32 even-numbered ejecting nozzles (c2, c4, c6 . . . c62, c64) arranged in the second line with a predetermined pitch and between the odd-numbered ejecting nozzles.

Similarly, the recording head 1B has 32 odd-numbered ejecting nozzles (m1, m3, m5 . . . m61, m63) in the first line and 32 even-numbered ejecting nozzles (m2, m4, m6 . . . m62, m64) in the second line, each nozzle being arranged with a predetermined pitch. The recording heads 1C and 1D each have 32 odd-numbered ejecting nozzles in the first line and 32 even-numbered ejecting nozzles in the second line, each nozzle being arranged with a predetermined pitch. Each ejecting nozzle is driven by one of the electromechanical transducers.

When the control block shown in FIG. 1 is adapted to control the ink jet printer having the color ink jet head shown in FIGS. 5–6, it is possible to select the first recording mode determined by the instruction from the host computer for performing color printing with high resolution of 720×720 dpi and high precision (but low speed), the high-speed recording mode of the second recording mode for performing color printing with low resolution of 180–180 dpi and the high-resolution recording mode of the second recording mode for performing color printing with medium resolution of 360×360 dpi and medium speed.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image recording apparatus comprising:

a recording head having a plurality of element arrays in a main scanning direction, each element array provided with a plurality of recording elements arranged at a same predetermined spacing in a subscanning direction approximately perpendicular to said main scanning direction;

driving means for driving the recording elements of the recording head;

a transporting mechanism that provides relative motion between the recording medium and the recording head in at least the subscanning direction; and selecting means for selecting a first recording mode and a second recording mode, the first and second recording modes having different dot pitches;

wherein, when the first recording mode is selected by said selecting means, said driving means uses a first number of the plurality of element arrays that is smaller than a second number of the plurality of element arrays used in the second recording mode and said transporting mechanism moves said recording medium relative to said recording head to record dot lines with said first number of the plurality of element arrays of the recording head between the dot lines previously recorded by said first number of the plurality of element arrays of the recording head.

2. The image recording apparatus of claim 1, wherein:

said plurality of element arrays in the main scanning direction includes first and second element arrays;

the recording elements of said first element array are arranged between the recording elements of said second element array; and when the second recording mode is selected by said selecting means, said driving means drives said recording head to record the dot lines formed by the recording elements of the second element array between the dot lines formed by the recording elements of the first element array.

3. The image recording apparatus of claim 2, wherein, in said second recording mode, said transporting mechanism moves said recording medium relative to said recording head in the subscanning direction to record subsequent dot lines formed by the recording elements of each element array of the second number of the plurality of element arrays adjacent the dot lines formed by the same element array in one character line.

4. The image recording apparatus of claim 3, wherein, when the first recording mode is selected by said selecting means, subsequent dot lines are recorded by said first number of the plurality of element arrays multiple times to print one character line between the dot lines initially recorded by said first number of the plurality of element arrays of the recording head to make the dot pitch smaller than the dot lines recorded in said second recording mode by the recording elements of said each element array of said second number of the plurality of element arrays adjacent the dot lines formed by the same element array.

5. The image recording apparatus of claim 1, wherein, when said first recording mode is selected, said transporting mechanism moves said recording medium relative to said recording head in the subscanning direction based upon a pitch smaller than the space between the dot lines recorded with said first number of the plurality of element arrays of the recording head or a pitch obtained by adding said smaller pitch to a distance given by multiplying the space between the dot lines by an integral number.

6. The image recording apparatus of claim 5, wherein said driving means utilizes only one element array.

7. The image recording apparatus of claim 1, wherein said driving means drives the recording elements to vary the dot pitch in said main scanning direction according to each recording mode.

8. The image recording apparatus of claim 1, wherein said recording head is an ink jet head for ejecting ink droplet toward the recording medium.

9. The image recording apparatus of claim 1, wherein the plurality of recording elements of the plurality of element arrays of the recording head, eject ink of the same color.

10. An image recording apparatus comprising:

a recording head having first and second element arrays arranged in a main scanning direction with respect to a recording medium, each element array including a plurality of recording elements arranged with a same predetermined spacing in a subscanning direction approximately perpendicular to the main scanning direction;

a controlling device that controls printing by the recording elements of the recording head;

a transporting mechanism that provides relative motion between the recording head and the recording medium in the main scanning direction and the direction perpendicular to the main scanning direction; and a selecting device that selects a first recording mode and a second recording mode having different dot pitches, respectively, wherein in the first recording mode the controlling device uses fewer element arrays than in the second recording mode, wherein in the first recording mode, the transporting mechanism initially moves said recording head in the main scanning direction relative to said recording medium to record initial dot lines by the recording elements of the first element array, and wherein the transporting mechanism subsequently moves the recording medium a plurality of times in the subscanning direction to record additional dot lines using the first element array between the initially recorded dot lines.

11. The image recording apparatus of claim 10, wherein the controlling device uses both the first and second element arrays in the second mode and uses one of the first and second element arrays in the first mode.

12. The image recording apparatus of claim 10, wherein the number of additional dot lines is seven to complete one character line of print.

13. The image recording apparatus of claim 10, wherein the transporting mechanism moves the recording head in the subscanning direction relative to said recording medium based on a pitch smaller than a space between adjacent recording elements of the first recording array or based on a pitch obtained by adding the smaller pitch to a multiple of the space between adjacent recording elements of the first recording array.

14. The image recording apparatus of claim 10, wherein a distance between the recording elements of the first and second element arrays is substantially equal.

15. The image recording apparatus of claim 10, wherein:

the recording elements of the first element array are arranged between the recording elements of the second element array; and the controlling device drives the recording head to record dot lines formed by the recording elements of the second element array between the dot lines formed by the recording elements of the first element array in a high speed submode of the second mode.

16. The image recording apparatus of claim 15, wherein the recording elements of the first and second element array complete one character line of print in one pass of the recording head in the main scanning direction.

17. The image recording apparatus of claim 16, wherein the transporting mechanism subsequently moves the recording medium in the subscanning direction and wherein the controlling device drives the recording head to record adjacent dot lines so that pairs of dot lines are formed by the recording elements of the second element array between pairs of dot lines formed by the recording elements of the first element array in one character line in a slow speed of the second mode.

18. The image recording apparatus of claim 17, wherein the recording elements of the first and second element array complete one character line of print in two passes of the recording head in the main scanning direction.

19. The image recording apparatus of claim 10, wherein the plurality of recording elements of the plurality arrays of the recording head, eject ink of the same color.

* * * * *